US010166601B2

(12) United States Patent
Slavens et al.

(10) Patent No.: US 10,166,601 B2
(45) **Date of Patent: *Jan. 1, 2019**

(54) DIE CAST TIP COVER AND METHOD OF MANAGING RADIAL DEFLECTION OF DIE CAST TIP

(71) Applicant: United Technologies Corporation, Hartford, CT (US)

(72) Inventors: Thomas N. Slavens, Moodus, CT (US); Nicholas M LoRicco, Coventry, CT (US)

(73) Assignee: United Technologies Corporation, Farmington, CT (US)

( * ) Notice: Subject to any disclaimer, the term of this patent is extended or adjusted under 35 U.S.C. 154(b) by 77 days.

This patent is subject to a terminal disclaimer.

(21) Appl. No.: 14/943,787

(22) Filed: Nov. 17, 2015

(65) Prior Publication Data

US 2017/0136531 A1 May 18, 2017

(51) Int. Cl.
*B22D 17/20* (2006.01)

(52) U.S. Cl.
CPC ..... *B22D 17/2038* (2013.01); *B22D 17/203* (2013.01); *B22D 17/2023* (2013.01)

(58) Field of Classification Search
CPC ..... B22D 17/203; B22D 17/2038
See application file for complete search history.

(56) References Cited

U.S. PATENT DOCUMENTS 2,932,865 A * 4/1960 Ferdinand ..... B22D 17/203 164/113
4,334,575 A 6/1982 Miki et al.
4,534,403 A 8/1985 Harvill
4,598,762 A 7/1986 Glas
4,886,107 A 12/1989 Zecman
5,246,055 A 9/1993 Fields et al.
6,871,691 B2 * 3/2005 Nakao ..... B22C 9/22 164/113
2001/0009186 A1 * 7/2001 Perrella ..... B22D 17/203 164/472
2009/0139683 A1 6/2009 Muller et al.
2012/0031580 A1 2/2012 Brondolin
(Continued)

FOREIGN PATENT DOCUMENTS

DE 202010008596 U1 12/2010
EP 2796226 A1 10/2014
(Continued)

OTHER PUBLICATIONS

Extended European Search Report for EP Application No. 16199295.3, dated Apr. 6, 2017, 8 pages.
(Continued)

*Primary Examiner* — Kevin E Yoon
*Assistant Examiner* — Jacky Yuen
(74) *Attorney, Agent, or Firm* — Kinney & Lange, P.A.

(57) ABSTRACT

A die casting plunger tip assembly includes a first portion having a closed end defining an outer face and a tip cover disposed on the outer face of the closed end. The tip cover includes a support structure extending from an inner surface of the tip cover toward the closed end. The support structure is positioned in contact with the outer face of the closed end and a cavity is formed between the outer face of the closed end and the tip cover.

19 Claims, 7 Drawing Sheets

(56) References Cited

U.S. PATENT DOCUMENTS

| | | | | |
|---|---|---|---|---|
| 2012/0111524 | A1* | 5/2012 | Schlichting | B22D 17/203 164/113 |
| 2013/0277004 | A1* | 10/2013 | Chow | B22D 17/203 164/137 |
| 2013/0284018 | A1 | 10/2013 | Tennar | |

FOREIGN PATENT DOCUMENTS

| | | | | |
|---|---|---|---|---|
| JP | 07032114 | A | * | 2/1995 |
| JP | 09174218 | A | * | 7/1997 |
| JP | 11239857 | A | * | 9/1999 |
| KR | 20020045177 | A | * | 6/2002 |
| KR | 20110001470 | A | | 1/2011 |
| WO | 2013001469 | A1 | | 1/2013 |

OTHER PUBLICATIONS

Extended European Search Report for EP Application No. 16199445.4, dated Mar. 24, 2017, 10 pages.

* cited by examiner

DIE CAST TIP COVER AND METHOD OF MANAGING RADIAL DEFLECTION OF DIE CAST TIP

BACKGROUND

The present application relates generally to methods and apparatuses for die casting, and more specifically to die casting plunger tips and methods used for casting high temperature alloy components.

Die casting is a metal casting process, which involves injecting a molten metal into a mold or multi-part die to form a component. The die casting process is commonly used for the manufacture of various metal components. A number of die casting apparatuses, generally tailored to lower temperature metal solutions such as aluminum, zinc, and magnesium, are known in the art. These die casting apparatuses use a plunger or piston to force molten metal through a shot tube into a mold. A tip of the plunger serves to force the molten metal into the mold while also forming a seal within the shot tube to prevent backflow of the molten metal around the plunger. Forming a seal necessitates that a gap between the plunger tip and the shot tube be controlled to a very small clearance. Because a high heat load associated with the molten metal can cause thermal expansion of the plunger tip and shot tube, a coolant is supplied to the plunger tip to limit thermal expansion of the plunger tip and limit radial binding of the plunger tip within the shot tube. The plunger tip is typically water cooled with water being supplied to a back side of the tip and evacuated through an annular jacket. Such configuration may be tailored to relatively low temperature melt solutions (e.g., generally around or below 1500° F. (815° C.)) and may not be effective for managing the higher heat loads associated with the casting of superalloys. For example, casting of superalloys may involve temperatures above 2500° F. (1371° C.). Thermal stresses may be high during such application and thus limit long-term durability of plunger tips.

A plunger tip or plunger tip assembly is needed for die casting of superalloy components which can allow for control of radial deflection of a tip under high transient thermal load and which can extend long-term durability of the plunger tip. That is, it may be advantageous to have a plunger tip or plunger tip assembly that may be configured to control expansion and contraction (i.e., radial deflection) of the material of the tip within the shot tube.

SUMMARY

In one embodiment of the present invention, a die casting plunger tip assembly includes a first portion having a closed end defining an outer surface, and a tip cover disposed on the outer surface of the closed end.

In another embodiment of the present invention, a method of controlling a radial clearance between a die casting plunger and a shot tube during transient heating includes actively cooling a back side of a plunger tip with a cooling fluid and covering at least a portion of an outer surface of the plunger tip along an end opposite the back side of the plunger tip.

In yet another embodiment of the present invention, a die casting plunger tip cover for controlling radial deflection of a die-casting tip under high thermal load includes a disk having a disk inner surface, a disk outer surface opposite the disk inner surface, and one or more support structures.

The present summary is provided only by way of example, and not limitation. Other aspects of the present disclosure will be appreciated in view of the entirety of the present disclosure, including the entire text, claims and accompanying figures.

Figure 1:
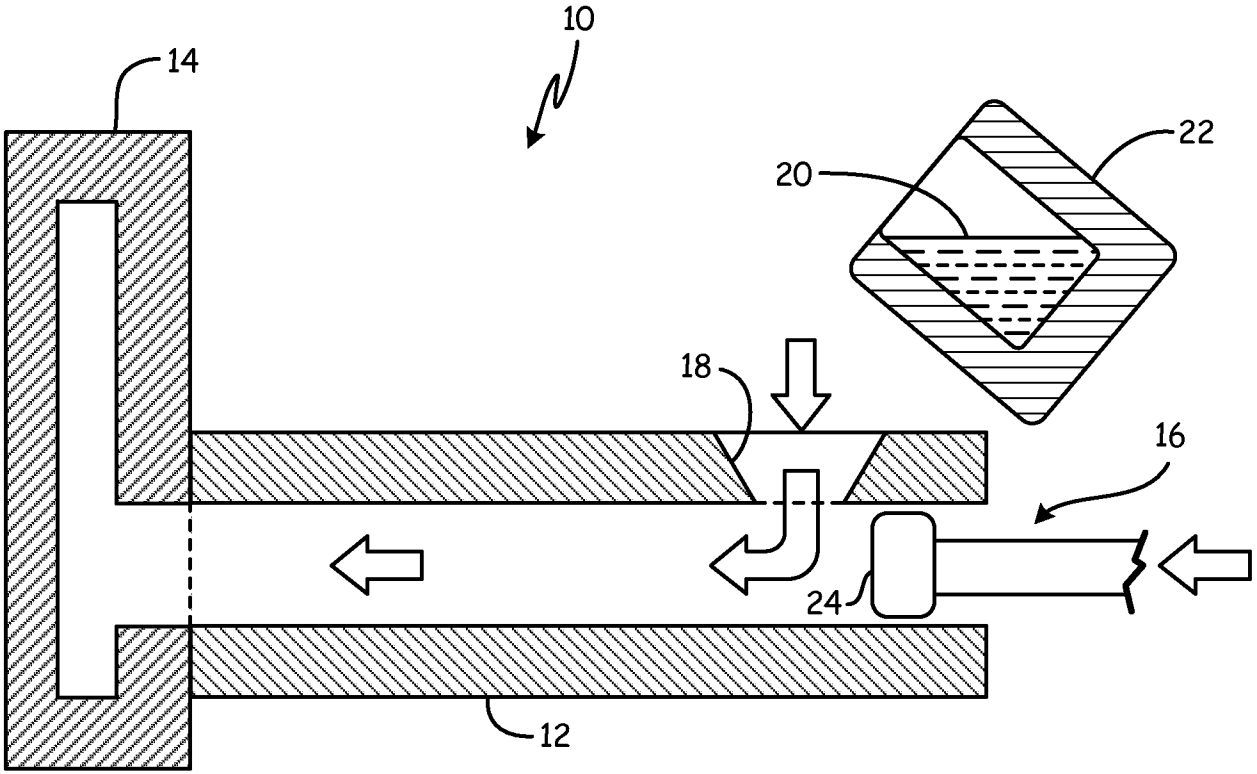
FIG. 1 is a simplified cross-sectional view of a die casting apparatus.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

A tip cover can be used to control radial deflection of a die-casting tip during transient heating (heating that occurs to the tip during the casting process when the tip is in contact with molten metal) and under high thermal load. The tip cover can help maintain a controlled radial clearance between the tip and a molten metal shot tube thereby limiting the potential for jamming due to thermal expansion of the tip. Furthermore, a tip cover can shield the tip, which would otherwise be in direct contact with a molten metal, thereby reducing thermal stresses to the tip and extending long-term durability of the tip. The tip cover can be disposable, reusable, or consumable. The tip cover can be attached to the tip via a clearance and/or interference fit and can be replaced with a new tip cover as necessary.

FIG. 1 is a simplified cross-sectional view of die casting apparatus 10. Die casting apparatus 10 can include shot tube 12, casting mold 14, and plunger 16. Shot tube 12 can be integrally connected with a portion of casting mold 14 or can be removably attached to casting mold 14, as known in the art. Shot tube 12 can include inlet 18, which opens into a central cavity in shot tube 12. Molten metal 20 can be poured from crucible 22 through inlet 18 into shot tube 12. Plunger 16 can be used to force molten metal 20 through the shot tube 12 and into casting mold 14. Plunger 16 can include plunger tip assembly 24, which may be configured to reduce a potential for or prevent backflow of molten metal 20 around plunger 16.

Shot tube 12, casting mold 14, and plunger 16 can each be comprised of a high-strength superalloy with high incipient melt temperature, such as, but not limited to, a high temperature nickel-based alloy or cobalt-based alloy. Shot tube 12, casting mold 14, and plunger 16 need not each be comprised of the same material. Generally, materials can be selected by matching expansion coefficients and wear characteristics of plunger tip assembly 24 and shot tube 12 to limit wear of components. Other materials, as known in the art, may be used for casting components made of materials with lower incipient melt temperatures, such as aluminum, zinc, and magnesium.

Figure 2:
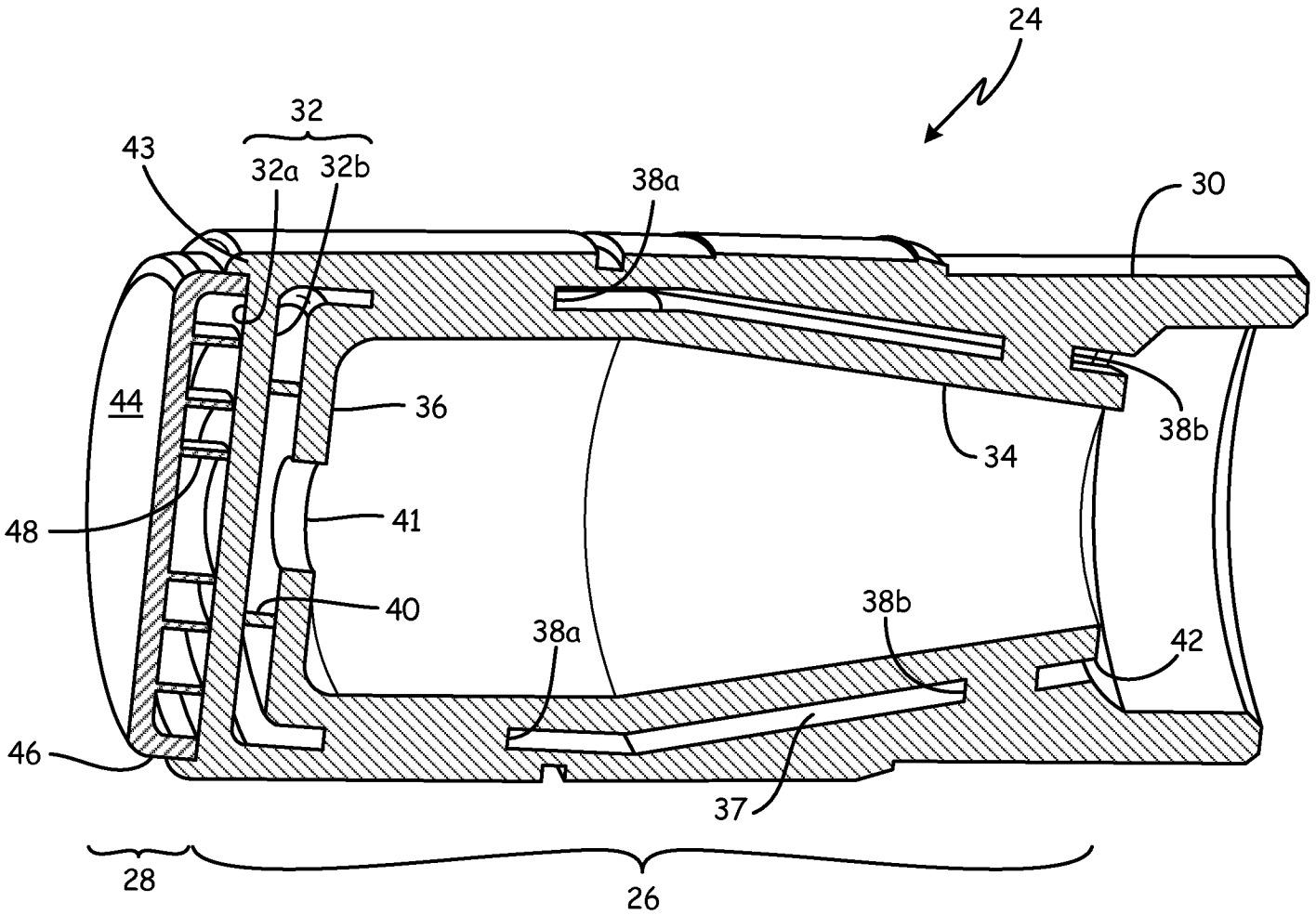
FIG. 2 is a perspective cross-sectional view of a one embodiment of a die casting plunger tip assembly.

FIG. 2 is a perspective cross-sectional view of one embodiment of plunger tip assembly 24. Plunger tip assembly 24 can include tip 26 and tip cover 28. Tip 26 can include outer portion 30 with closed end 32, defining an outer surface 32*a* and back side cooling surface 32*b*, and inner portion 34 with end 36. Outer portion 30 and inner portion 34 can be hollow structures, with inner portion 34 housed or contained within outer portion 30. Inner portion 34 can be a fluid supply portion and a fluid evacuation portion may be formed between an outer surface of the inner portion 34 and an inner surface of the outer portion 30. For example, inner portion 34 can be disposed within outer portion 30, substantially separated by a cooling fluid plenum disposed around inner portion 34 and between ends 32 and 36. In some embodiments, outer portion 30 and inner portion 34 can be integrally and monolithically formed using additive manufacturing or other techniques known in the art, and can be integrally connected by one or more connectors or ribs (38*a*, 38*b*, 40). Alternatively, outer portion 30 and inner portion 34 can be manufactured separately and combined and/or attached to form the tip 26. Outer portion 30 and inner portion 34 can be substantially annular. In a non-limiting embodiment, outer portion 30 can have a thin wall with wall thicknesses generally ranging from 1.27 mm (0.05 inches) to 4.47 mm (0.175 inches). In various embodiments, inner portion 34 can have a wall thickness substantially equal to, greater than, or less than the wall thickness of outer portion 30. Inner portion 34 can effectively serve as a heat sink for heat conducted from tip cover 28 and closed end 32. In some areas where a heat sink can be most beneficial, inner portion 34 can have a wall thickness up to three times greater than the wall thickness of outer portion 30.

Connectors 38*a* and 38*b* can connect inner portion 34 and outer portion 30. Connectors 38*a* and 38*b* can be disposed along an axial length of inner portion 34. Generally, a plurality of connectors 38*a* can be disposed around a perimeter or exterior surface of inner portion 34 near end 36. Connectors 38*b* can be disposed along an axial length of inner portion 34 at a distance from connectors 38*a*. Similar to connectors 38*a*, a plurality of connectors 38*b* can be disposed around the perimeter or exterior surface of inner portion 34. Connectors 38*a* and 38*b* can be located to maintain the plenum between outer portion 30 and inner portion 34 and to provide a conduction path for cooling outer portion 30. Connectors 38*a* and 38*b* can each be a substantially rectangular prism in shape, although those of skill in the art will appreciate that the connectors 38*a* and 38*b* are not limited to a rectangular prism construction. As shown in FIG. 2, connectors 38*a* can be longer in length than connectors 38*b*, thereby providing an increased area for thermal conduction between outer portion 30 and inner portion 34 near a forward end of plunger tip assembly 24. It will be understood by one skilled in the art that connectors 38*a* and 38*b* can be modified in position, shape, and number as needed to provide structural support and thermal management of plunger tip assembly 24.

One or more additional connectors 40 can be disposed between closed end 32 of the outer portion 30 and end 36 of the inner portion 34. As shown in FIG. 2, connectors 40 can comprise pedestal-style supports, however, connectors of other configurations and shapes can be used Like connectors 38*a* and 38*b*, connectors 40 can be positioned to maintain a plenum between ends 32 and 36 and to provide a conduction path for cooling closed end 32 and tip cover 28.

Figure 3:
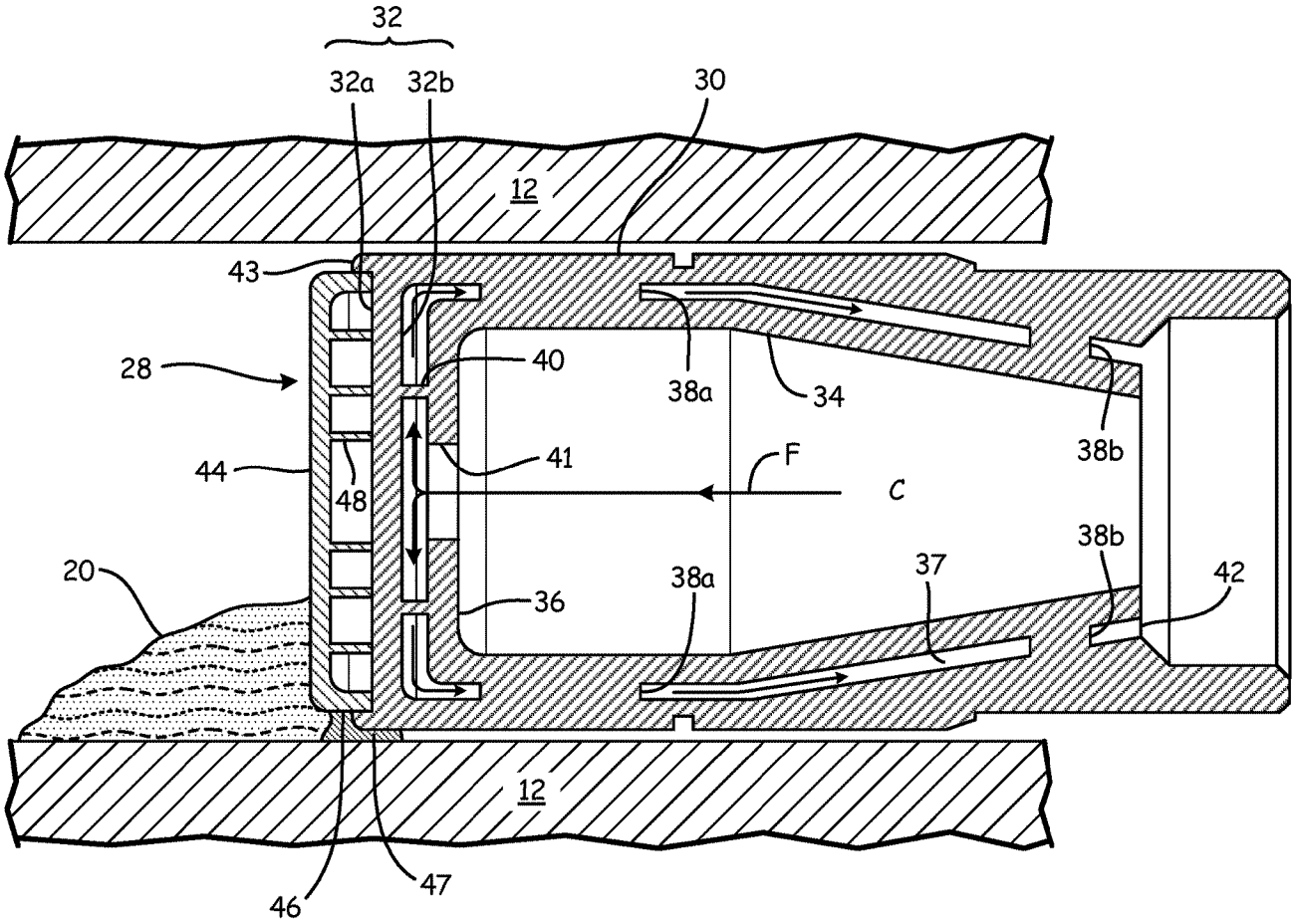
FIG. 3 is a cross-sectional view of a portion of the die casting apparatus of FIG. 1 and die casting plunger tip assembly of FIG. 2.

FIG. 3 is a cross-sectional view of a portion of a die casting apparatus of FIG. 1 and die casting plunger tip assembly of FIG. 2. Cooling fluid can be supplied to back side cooling surface 32*b* of closed end 32 and to plenum 37 disposed between inner portion 34 and outer portion 30. Cooling fluid can be supplied to reduce thermal expansion of the material of tip 26 during a die casting process due to exposure of plunger tip assembly 24 to molten metal 20. The cooling fluid can enter a central cavity C in inner portion 34 and flow through central hole 41 in end 36 of inner portion 34 into plenum 37 disposed between closed end 32 and end 36 and outer and inner portions 30 and 34. The cooling fluid can exit the plenum between outer portion 30 and inner portion 34 at a back end 42 of tip 26. In some embodiments, cooling fluid can be continuously circulated at high velocity through tip 26. As cooling fluid flows between outer portion 30 and inner portion 34, it effectively removes heat from plunger tip assembly 24. The thin-walled outer portion 30 can allow for uniform cooling of plunger tip assembly 24, keeping both outer portion 30 and inner portion 34 near an initial temperature (in some embodiments the initial temperature may be around 70° F. (21° C.)) and thereby maintaining tip 26 at a near-constant radial dimension during the die casting process. That is, the uniform cooling may prevent or control thermal expansion of portions of the tip 26.

Tip cover 28 can reduce radial deflection caused by thermal expansion and contraction of tip 26 and thereby help to control the radial clearance between the tip 26 and shot tube 12 during transient heating. Furthermore, tip cover 28 can help shield tip 26 from high thermal stresses. Tip cover 28 can be disposed on outer surface 32*a* of closed end 32 to shield a substantial portion (in some embodiments, greater than 85% of the surface area) of the highly cooled tip 26 from making contact with molten metal 20. Tip cover 28 can be substantially circular, matching a shape of closed end 32 and can be disposed within tip outer rim 43 of closed end 32. In one embodiment, tip cover 28 can have a maximum outer diameter that is less than an outer diameter of outer portion 30. Tip outer rim 43 can be disposed about and extend from a perimeter of outer surface 32*a* of closed end 32 to engage tip cover 28 upon assembly. Tip cover 28 can be loosely held in place by tip outer rim 43. During the die casting process, tip cover 28 can thermally expand to form a tight fit or interference fit within tip outer rim 43. Upon cooling, tip cover 28 can contract and release from outer rim 43 and closed end 32 when tip 26 is removed from shot tube 12. Utilizing thermal expansion of tip cover 28 for retention within and to tip 26, as opposed to fixed retention features such as threaded interfaces, can simplify assembly and removal of tip cover 28. However, in some embodiments, the tip cover 28 may be configured to removably and fixedly attach to the tip 26, such as by threads, tooth-slot-joint, or other connection mechanism.

Tip cover 28 can be reusable, disposable, or consumable. Tip cover 28 can adhere to a metal component (e.g., within mold 14) during the die casting process, and separate from tip 26 when tip 26 is pulled back through shot tube 12. Tip cover 28 can be removed from the component during die casting shakeout, or trimming processes and can be reapplied to tip 26 for reuse. In some embodiments, after multiple uses, the ability of tip cover 28 to shield tip 26 may be reduced and tip cover 28 can be disposed of and replaced. Alternatively, tip cover 28 can made of a material common to the metal component formed within mold 14, such that tip cover 28 can be removed from the component in a trimming process and added to crucible 22 for melting and casting, i.e., the tip cover 28 can be recycled. A casting method is described further below with respect to FIG. 9.

Tip cover 28 can include a thermal barrier coating, such as a low-conductivity ceramic coating, to reduce thermal shock and heat load to plunger tip 26. In one embodiment, the thermal barrier coating can be applied a surface of tip cover 28 exposed to molten metal 20. The use of a thermal barrier coating can reduce the amount of convective cooling needed to cool plunger tip 26 and can help control radial deflections of plunger tip assembly 24 due to thermal contraction or expansion. In some embodiments, tip cover 28 can have a melting point near or below that of molten metal 20, in which case, ceramic coatings can provide beneficial thermal shielding of tip cover 28 during the die casting process.

Figure 5:
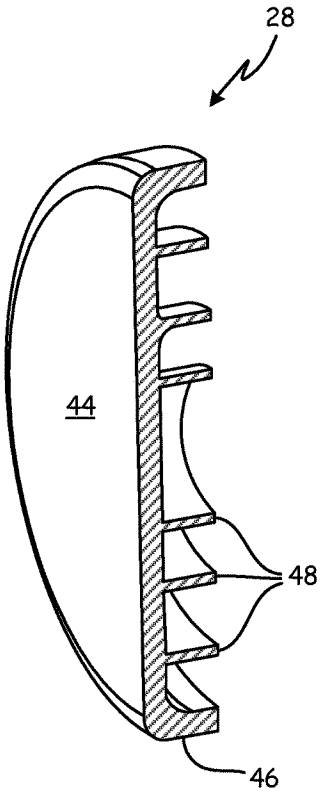
FIG. 5 is a cross-sectional view of the die casting plunger tip cover taken along the line 5-5 of FIG. 4.
Figure 4:
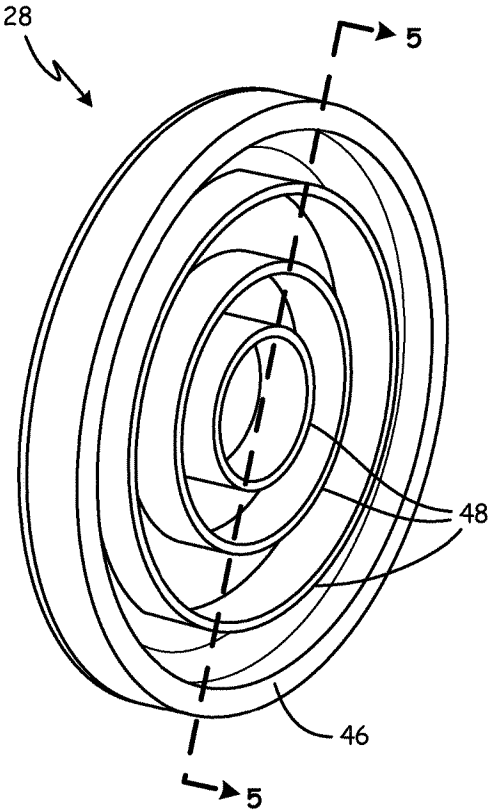
FIG. 4 is a perspective view of one embodiment of a die casting plunger tip cover.

FIGS. 2-5 show one embodiment of a tip cover 28. FIG. 4 is a perspective view of tip cover 28; FIG. 5 is a cross-sectional view of tip cover 28 taken along the line 5-5 of FIG. 4. In the embodiment shown in FIGS. 2-5, tip cover 28 can have a cap-like shape, having disk 44 with rim 46 extending from a perimeter of an inner surface of disk 44 to engage outer surface 32*a* of closed end 32 upon assembly. As shown in FIG. 2, tip cover rim 46 can be disposed within outer rim 43 of tip 26 and positioned in contact with outer surface 32*a* of closed end 32. Tip cover rim 46 can cause a portion of disk 44 of tip cover 28 to be displaced from outer surface 32*a* of closed end 32, creating one or more cavities (e.g., air plenums) between closed end 32 and an inner surface of disk 44 of tip cover 28. Outer rim 43 of tip 26 can have an axial length less than rim 46 of tip cover 28, such that tip cover 28 extends outward from outer rim 43. Further, rim 46 of tip cover 28 can have a maximum diameter less than outer rim 43, such that tip cover 28 can fit within tip outer rim 43 and such that tip outer rim 43 is exposed to molten metal 20 during the die casting process (shown in FIG. 3). Because outer rim 43 of tip 26 can be highly cooled by cooling fluid circulating through tip 26, molten metal 20 can more quickly solidify at tip outer rim 43 than tip cover 28, which is displaced from the cooling fluid. Solidified metal 47 in the area of tip outer rim 43 can limit flow of molten metal 20 past the tip outer rim 43 and along a length of tip 26 in shot tube 12 Like tip cover 28, the solidified metal 47 can also shield tip 26 from molten metal 20.

Tip cover 28 can include one or more support structures 48 positioned radially inward of tip cover rim 46 along the inner surface of the disk 44. Support structures 48 can help stiffen tip cover 28, and can optionally contact closed end 32 of tip 26 to provide structural support and/or conductive heat transfer. In one embodiment, a length of each of the one or more support structures 48 can be substantially equal to a length of tip cover rim 46, such that both tip cover rim 46 and support structures 48 make contact with closed end 32 upon assembly. FIGS. 2-5 illustrate a plurality of support structures 48 comprising concentric rings. It will be understood by one skilled in the art that a variety of support structures may be configured to serve these purposes and thus support structures as described and employed herein are not limited in shape, position, or number to the support structures 48 shown in FIGS. 2-5. For example, in some embodiments, the support structures may be configured as spokes extending from a center point on the inner surface of the disk 44 to the tip cover rim 46. A wall thickness of support structures 48 can be reduced to limit heat transfer to closed end 32. In the embodiment shown in FIGS. 2-5, the wall thickness of support structures 48 is less than a wall thickness of tip cover rim 46, i.e., thickness in a radial direction of disk 44, although embodiments provided herein are not so limited. In some embodiments, tip cover rim 46 can have a wall thickness equal to a thickness of disk 44.

Figure 7:
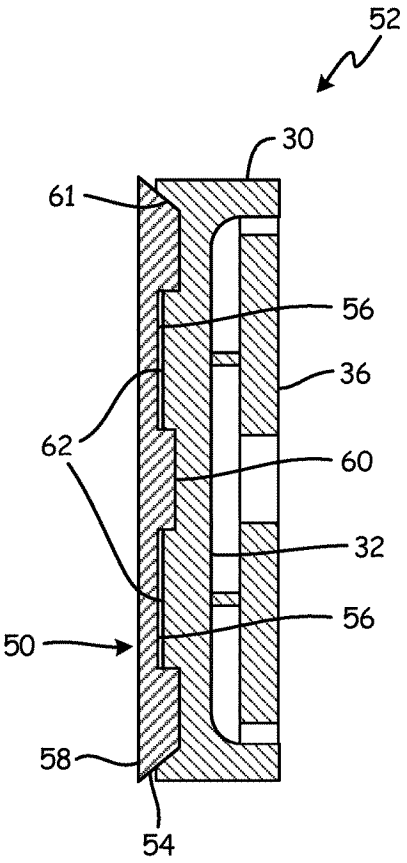
FIG. 7 is a cross-sectional view of the assembled die casting plunger tip cover taken along the line 7-7 of FIG. 6.
Figure 6:
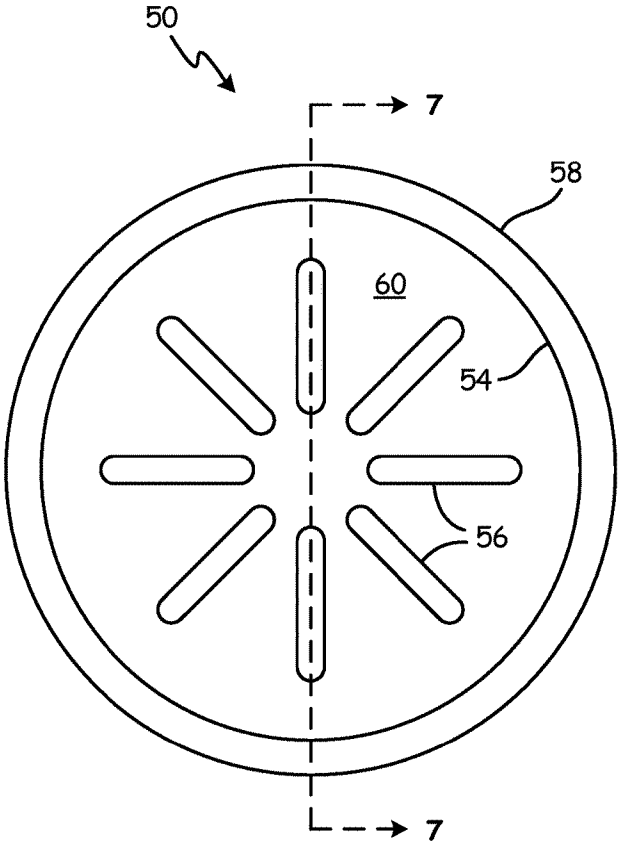
FIG. 6 is an elevation view of another embodiment of a die casting plunger tip cover.
Figure 8:
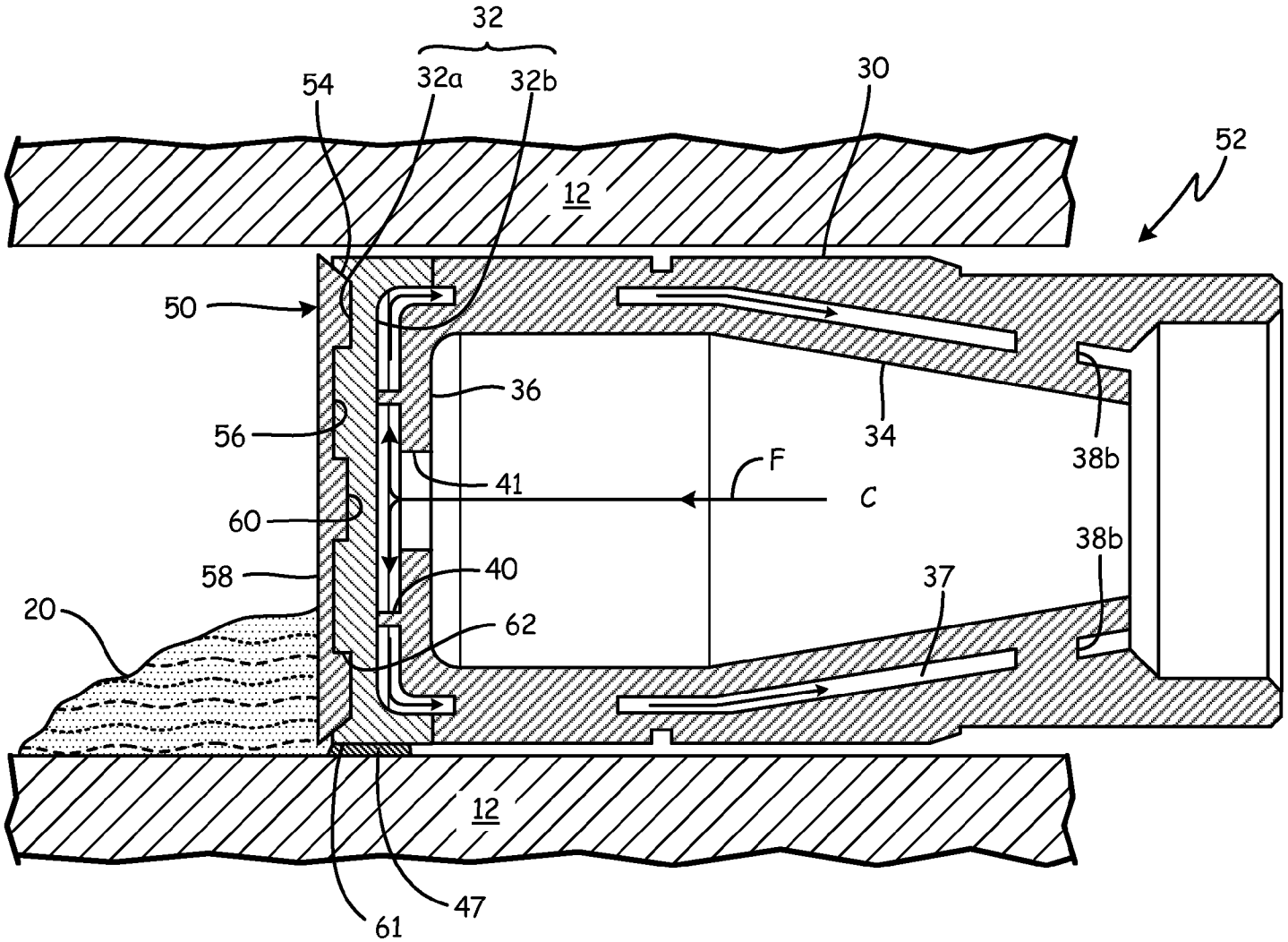
FIG. 8 is a cross-sectional view of a portion of the die casting plunger tip assembly of FIG. 7 and die casting apparatus of FIG. 1.

FIGS. 6-8 illustrate another embodiment of a tip cover and plunger tip assembly, respectively. FIG. 6 is an elevation view of tip cover 50; FIG. 7 is a cross-sectional view of plunger tip assembly 52 taken along the line 7-7 of FIG. 6; and FIG. 8 is a cross-sectional view of a portion of the die casting plunger tip assembly of FIG. 7 and die casting apparatus of FIG. 1. As shown in FIG. 6, tip cover 50 can have a disk-like shape with a chamfered outer edge or perimeter 54 and a plurality of slots 56. Outer edge 54 of tip cover 50 can taper radially inward from disk outer surface 58 to disk inner surface 60. The chamfered shape of outer edge 54 can substantially match a chamfered surface of rim 61 on closed end 32 of tip 26. As such, tip cover 50 can be disposed within rim 61 of closed end 32.

Similar to the embodiment shown in FIGS. 2 and 3, tip cover 50 can be disposed on an outer surface of closed end 32 to shield a substantial portion of the highly cooled tip 26 from making contact with molten metal 20 and thereby help control the radial deflection of tip 26 due to thermal expansion and contraction of the material of the tip 26. Tip rim 61 can extend from a perimeter of outer surface 32*a* of closed end 32 toward tip cover 50. Tip rim 61 can have a chamfered inner edge configured to engage chamfered outer edge 54 of tip cover 28. In some embodiments, tip cover 50 can be loosely held in place by rim 61 thereby allowing for thermal expansion of tip cover 50 during the die casting process. In some embodiments, tip cover 50 can form a tight or interference fit with rim 61 upon thermal expansion of tip cover 50. Further, tip cover 50 can adhere to molten metal 20 as molten metal 20 solidifies. Upon completion of the die casting process, tip 50 can cool and contract from rim 61, such that tip cover 50 separates from closed end 32 when tip 26 is removed from shot tube 12. Like tip cover 28, tip cover 50 can also be reusable, disposable, or consumable.

Tip cover 50 can include a plurality of slots 56, which can extend through a partial thickness of tip cover 50, opening to disk inner surface 60. As shown in FIG. 6, slots 56 can be disposed radially from a center of disk inner surface 60 and spaced apart from the center and outer edge 54 of disk inner surface 60. Closed end 32 can have a plurality of protrusions 62 extending from outer surface 32*a*, which faces tip cover 50 upon assembly. Protrusions 62 can substantially match slots 56 in shape and position such that protrusions 62 can be inserted into slots 56 upon assembly. A depth of slots 56 (measured as a distance to which slots extend into disk 44 from disk inner surface 60) and length of protrusions 62 (measured as a distance to which protrusions extend outward from outer surface 32*a* of closed end 32) can be set to allow disk inner surface 60 to contact closed end 32 and create a plenum between each protrusion 62 and slot 56. Disk inner surface 60 can provide structural support for tip cover 50 and a cooling conduction path, while the plurality of plenums created between protrusions 62 and slots 56 can create a break in thermal conductivity thereby limiting heat transfer to closed end 32. It will be understood by one skilled in the art that the shape, number, and position of slots 56 and protrusions 62 can be modified as needed to optimize structural support and thermal management. For example, the slots can be configured as concentric rings that are configured to mate with concentric ring protrusions on the closed end.

FIG. 8 is a cross-sectional view of a portion of the die casting plunger tip assembly of FIG. 7 and die casting apparatus of FIG. 1. Unlike tip cover 28, shown in FIGS. 2-5, tip cover 50 can have an outer diameter on disk outer surface 58 substantially equal to a maximum outer diameter of outer portion 30 (and tip rim 61). Therefore, tip cover 50 can substantially limit backflow of molten metal 20 along tip assembly 52. Highly convective thermal cooling of closed end 32 can draw heat from tip cover 50 to limit the potential for thermal expansion of the tip cover 50. In some embodiments, tip cover 50 may be employed in die casting processes of short duration (e.g., 3 seconds) Like tip cover 28, tip cover 50 can include a thermal barrier coating to reduce thermal shock and heat load to tip 26.

Figure 9:
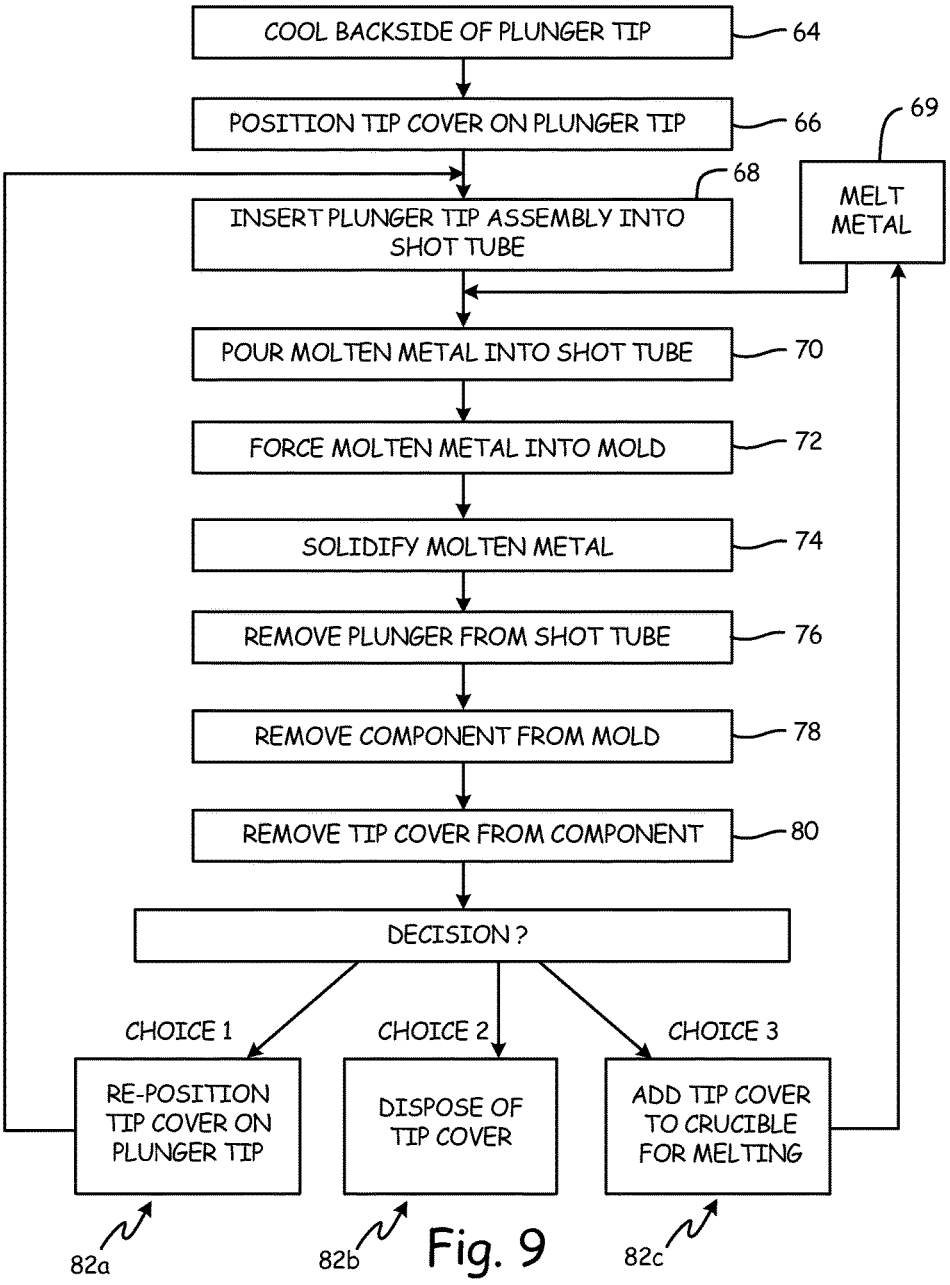
FIG. 9 is a flow chart for use of the die casting apparatus and plunger tip cover.

FIG. 9 is a simplified flow chart of a casting process in accordance with a non-limiting embodiment. The process involves the steps 64-82*c*, not necessarily conducted in the order shown. Steps include: cooling the back side of plunger tip 26 with cooling fluid (step 64), positioning tip cover 28 on outer surface 32*a* of closed end 32 opposite back side 32*b* (step 66), inserting plunger tip assembly 24 into shot tube 12 (step 68), pouring molten metal 20 into shot tube 12 (step 70), forcing molten metal 20 into mold 14 with plunger tip assembly 24 (step 72); allowing molten metal 20 to solidify (step 74); removing plunger tip 26 from shot tube 12 (step 76); removing metal component (not shown) from mold 14 (step 78); optionally removing tip cover 28 from component (step 80); and optionally reusing (step 82*a*), optionally disposing of (step 82*b*), or optionally adding tip cover 28 to crucible 22 (step 82*c*) and again melting metal 22 (step 69) for the production of additional components. If after component formation, tip cover 28 is repositioned on plunger tip 26, the process can continue with step 68.

Highly cooled die casting plunger tip assembly 16 with tip cover 28 or tip cover 50 can be used in die casting processes having high heat loads, such as exists in the processing of superalloys. Tip covers 28 and 50, and variations thereon, can effectively shield highly cooled tip 26, limiting the radial deflection of tip 26 due to thermal expansion and contraction and thermal stresses to tip 26 during the die casting process. Tip covers 28 and 50 can thereby increase the durability and extend the life of tip 26 and reduce a cost per shot. Tip covers 28 and 50 can be disposable, reusable, or consumable.

The following are non-exclusive descriptions of possible embodiments of the present invention.

A die casting plunger tip assembly can include a first portion having a closed end defining an outer surface, and a tip cover disposed on the outer surface of the closed end.

The die casting plunger tip assembly of the preceding paragraph can optionally include, additionally and/or alternatively, any one or more of the following features, configurations and/or additional components:

A further embodiment of the die casting plunger tip assembly, wherein the tip cover can have an outer diameter that is less than an outer diameter of the first portion.

A further embodiment of any of the foregoing die casting plunger tip assemblies, wherein the closed end can have an outer rim disposed about and extending from a perimeter of the outer surface of the closed end toward the tip cover.

A further embodiment of any of the foregoing die casting plunger tip assemblies, wherein the tip cover fits within the outer rim of the closed end.

A further embodiment of any of the foregoing die casting plunger tip assemblies, wherein the tip cover can have a rim disposed about and extending from a perimeter of an inner surface of the tip cover toward the closed end. The rim of the tip cover can be positioned in contact with the outer surface of the closed end.

A further embodiment of any of the foregoing die casting plunger tip assemblies, wherein the outer rim of the closed end can have a chamfer.

A further embodiment of any of the foregoing die casting plunger tip assemblies, wherein the tip cover can have an outer edge with a chamfer substantially matching the chamfer on the outer rim of the closed end, and wherein the tip cover can fit within the outer rim of the closed end.

A further embodiment of any of the foregoing die casting plunger tip assemblies, wherein at least a portion of the tip cover can have an outer diameter that is substantially equal to a maximum outer diameter of the first portion.

A further embodiment of any of the foregoing die casting plunger tip assemblies, wherein one or more protrusions can extend from the outer surface of the closed end, and one or more slots can extend through a partial thickness of the tip cover and open toward the outer surface of the closed end. The one or more protrusions can be inserted into the one or more slots and can create a plenum between a portion of the tip cover and the closed end.

A further embodiment of any of the foregoing die casting plunger tip assemblies, wherein the tip cover can have a rim disposed about and extending from a perimeter of an inner surface of the tip cover toward the closed end. The rim can positioned in contact with an outer surface of the closed end. The tip cover can have one or more support structures positioned in contact with the outer surface of the closed end.

A further embodiment of any of the foregoing die casting plunger tip assemblies including a second portion located within the first portion and a fluid conduit formed between the first and second portions and in fluid communication with a central cavity of the second portion. The first and second portions can be hollow structures. One or more connectors can connect the first and second portions.

A method of controlling a radial clearance between a die casting plunger and a shot tube during transient heating can include actively cooling a back side of a plunger tip with a cooling fluid and covering at least a portion of an outer surface of the plunger tip along an end opposite the back side of the plunger tip.

The method of the preceding paragraph can optionally include, additionally and/or alternatively, any one or more of the following features, configurations and/or additional components:

A further embodiment of the method of controlling a radial clearance, wherein the step of covering at least a portion of the outer surface of the plunger tip can include disposing a tip cover on the outer surface using either a clearance fit or an interference fit.

A further embodiment of any of the foregoing methods of controlling a radial clearance can include the steps of applying force to the die cast plunger, forcing a molten metal into a mold, allowing the molten metal to solidify, affixing the tip cover to the molten metal during solidification, and removing the tip cover from the plunger tip upon removal of the plunger tip from the shot tube.

A further embodiment of any of the foregoing methods of controlling a radial clearance, wherein the step of covering at least a portion of the outer surface of the plunger tip can include the step of positioning a tip cover on the outer surface and creating one or more cavities between the tip cover and the outer surface.

A further embodiment of any of the foregoing methods of controlling a radial clearance can include supplying cooling fluid to an inner portion of the plunger tip and supplying cooling fluid to a plenum disposed between the inner portion and an outer portion and including the backside of the plunger tip.

A die casting plunger tip cover for controlling radial deflection of a die-casting tip under high thermal load can include a disk having a disk inner surface, a disk outer surface opposite the disk inner surface, and one or more support structures.

A further embodiment of the foregoing die casting plunger tip cover, wherein the disk can further include a rim disposed about a perimeter of the disk and protruding from the inner surface, and wherein the one or more support structures can protrude from the inner surface. A length of protrusion of the rim from the disk can be substantially equal to a length of protrusion of the one or more support structures from the disk. The rim can have a first thickness and the one or more support structures can have a second thickness that is less that the first thickness.

A further embodiment of the foregoing die casting plunger tip cover, wherein the one or more support structures can form one or more concentric rings.

A further embodiment of the foregoing die casting plunger tip cover, wherein the disk can further include an outer edge joining the disk outer and inner surfaces and one or more slots open to the disk inner surface. The outer edge can include a chamfer, tapering radially inward from the disk outer surface to the inner surface. The one or more slots can extend through a partial thickness of the disk and can be disposed radially from a center of the disk.

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, alignment or shape variations induced by thermal, rotational or vibrational operational conditions, and the like.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A die casting plunger tip assembly comprising:

a first portion having a closed end defining an outer face; and a tip cover disposed on the outer face of the closed end and attached to the closed end only by a clearance fit or an interference fit; the tip cover having a monolithic body comprising:

an integrally formed support structure extending from an inner surface of the tip cover toward the closed end, the support structure being positioned in contact with the outer face of the closed end;

wherein a cavity is formed between the outer face of the closed end and the tip cover.

2. The die casting plunger tip assembly of claim 1, wherein the tip cover has an outer diameter that is less than an outer diameter of the first portion.

3. The die casting plunger tip assembly of claim 1, wherein the closed end has an outer rim disposed about and extending from a perimeter of the outer face of the closed end toward the tip cover.

4. The die casting plunger tip assembly of claim 3, wherein the tip cover fits within the outer rim of the closed end.

5. The die casting plunger tip assembly of claim 4, wherein the support structure comprises a rim disposed about and extending from a perimeter of the inner surface of the tip cover toward the closed end.

6. The die casting plunger tip assembly of claim 3, wherein the outer rim of the closed end has a chamfer.

7. The die casting plunger tip assembly of claim 6, wherein the tip cover has an outer edge with a chamfer substantially matching the chamfer on the outer rim of the closed end, and wherein the tip cover fits within the outer rim of the closed end.

8. The die casting plunger tip assembly of claim 1, wherein at least a portion of the tip cover has an outer diameter that is substantially equal to a maximum outer diameter of the first portion.

9. The die casting plunger tip assembly of claim 1, wherein one or more protrusions extend from the outer face of the closed end, and one or more slots extend through a partial thickness of the tip cover and open toward the outer face of the closed end, the one or more protrusions being inserted into the one or more slots and creating the cavity between a portion of the tip cover and the outer face of the closed end.

10. The die casting plunger tip assembly of claim 5, wherein the tip cover further comprises:

one or more additional support structures extending from the inner surface toward the outer face of the closed end.

11. The die casting plunger tip assembly of claim 1, further comprising:

a second portion located within the first portion, wherein the first and second portions are hollow structures;

one or more connectors connecting the first and second portions; and a fluid plenum formed between the first and second portions and in fluid communication with a central cavity of the second portion.

12. The die casting plunger tip assembly of claim 10, wherein the one or more additional support structures comprise one or more rings.

13. The die casting plunger assembly of claim 10, wherein the one or more additional support structures are in contact with the outer face of the closed end.

14. The die casting plunger assembly of claim 5, and further comprising:

one or more additional support structures extending from the inner surface toward the outer face of the closed end;

wherein the rim has a first wall thickness and each of the one or more additional support structures has a second wall thickness, the second wall thickness being less than the first wall thickness.

15. The die casting plunger tip assembly of claim 12, wherein the one or more rings are concentric with the rim.

16. A method of controlling a radial clearance between a die casting plunger and a shot tube during transient heating, the method comprising the steps of:

actively cooling a back side of a closed end of a plunger tip with a cooling fluid; and covering at least a portion of an outer surface of the closed end of the plunger tip opposite the back side of the plunger tip with a tip cover attached to the closed end only by a clearance fit or an interference fit wherein the die casting plunger comprises a tip assembly having:

a first portion having the closed end, wherein the closed end defines an outer face; and the tip cover disposed on the outer face of the closed end; the tip cover having a monolithic body comprising:

an integrally formed support structure extending from an inner surface of the tip cover toward the closed end, the support structure being positioned in contact with the outer face of the closed end;

wherein a cavity is formed between the outer face of the closed end and the tip cover.

17. The method of claim 16, further comprising the steps of:

applying force to the die cast plunger;

forcing a molten metal into a mold;

allowing the molten metal to solidify;

affixing the tip cover to the molten metal during solidification; and removing the tip cover from the plunger tip by removing the plunger tip from the shot tube.

18. The method of claim 16, wherein the step of covering at least a portion of the outer surface of the plunger tip comprises the step of:

positioning the tip cover on the outer surface, wherein positioning the tip cover on the outer surface creates one or more cavities between the tip cover and the outer surface.

19. The method of claim 16, further comprising the steps of:

supplying cooling fluid to an inner portion of the plunger tip;

supplying cooling fluid to a plenum disposed between the inner portion and an outer portion of the plunger tip and including the back side of the plunger tip.

* * * * *